US011161221B2

(12) United States Patent
St. John

(10) Patent No.: US 11,161,221 B2
(45) Date of Patent: Nov. 2, 2021

(54) DEVICE FOR MAINTAINING A PLURALITY OF DOORS IN AN UPRIGHT POSITION, AND METHOD

(71) Applicant: Marcel St. John, Belle Riviere (CA)

(72) Inventor: Marcel St. John, Belle Riviere (CA)

(73) Assignee: 637894 Ontario Inc., Belle Riviere (CA)

( * ) Notice: Subject to any disclaimer, the term of this patent is extended or adjusted under 35 U.S.C. 154(b) by 192 days.

(21) Appl. No.: 16/154,972

(22) Filed: Oct. 9, 2018

(65) Prior Publication Data

US 2020/0108488 A1 Apr. 9, 2020

(51) Int. Cl.
*B25B 11/02* (2006.01)
*B05B 13/02* (2006.01)

(52) U.S. Cl.
CPC ..... *B25B 11/02* (2013.01); *B05B 13/0285* (2013.01)

(58) Field of Classification Search
CPC ... B25B 11/00; B25B 11/02; Y10T 29/49998; B05B 13/0285
USPC ..... 211/70, 163
See application file for complete search history.

(56) References Cited

U.S. PATENT DOCUMENTS 5,551,980 A * 9/1996 Turnbo ..... B05B 13/0285 118/500
2011/0193279 A1* 8/2011 St. John ..... B25B 11/00 269/1

OTHER PUBLICATIONS

AlbertaUArts, Scoring and Bending, Jan. 25, 2017 https://www.youtube.com/watch?v=jtJe9xIK4js (Year: 2017).*

* cited by examiner

*Primary Examiner* — Tyrone V Hall, Jr.
*Assistant Examiner* — Abbie E Quann
(74) *Attorney, Agent, or Firm* — Renner Kenner Greive Bobak Taylor & Weber

(57) ABSTRACT

A device for maintaining a plurality of doors in an upright position includes a body with a plurality of connecting portions extending therefrom. Each connecting portion has a connecting surface configured to abut a side of one of the doors.

11 Claims, 7 Drawing Sheets

DEVICE FOR MAINTAINING A PLURALITY OF DOORS IN AN UPRIGHT POSITION, AND METHOD

FIELD OF THE INVENTION

The present invention relates generally to doors and in particular, to a device for maintaining a plurality of doors in an upright position, and a method.

BACKGROUND OF THE INVENTION

During construction of a building such as a house or office complex, one or more doors may require treatment such as the application of paint or finishing materials such as stains and the like prior to being installed into a door opening or doorframe. One common method of positioning the door for treatment is to rest the door on one of its surfaces and treat the opposite surface. After the surface has been treated, the door is turned over and the untreated surface of the door is then treated. Such a method is time-consuming and requires excessive handling of the door. Additionally, as the door is generally slanted during the treatment, excess paint or other finishing materials tend to collect in a particular location resulting in an uneven treatment.

To address such problems, door finishing racks have been proposed whereby the door is hung from a rack and is completely treated while supported by the rack. While such prior art devices work with varying degrees of efficiency, they tend to suffer from one or more drawbacks. Many door finishing racks are unusually complex in design and construction, making the racks expensive to manufacture and time-consuming to assemble and use. Exemplary door finishing racks of the prior art include U.S. Pat. Nos. 2,814,321; 5,551,980; 5,894,945; and 6,702,130. These devices have limited functionality and are large and cumbersome to transport from one construction site to another, thereby making such racks of limited value to builders. U.S. Pat. No. 5,846,016 describes a portable device that connects to the hinge attachment location on the door, however, it is time-consuming to affix the device to the attachment location and subsequently remove it after treatment has been completed. Furthermore, there is a considerable risk of damaging the screw holes in the hinge attachment locations of the door by cross-threading when attaching the device to the hinge attachment locations.

Improvements are generally desired. It is therefore an object of the present invention at least to provide a novel device for maintaining a plurality of doors in an upright position, and a method.

SUMMARY OF THE INVENTION

It should be appreciated that this summary is provided to introduce a selection of concepts in a simplified form that are further described below in the detailed description. This summary is not intended to be used to limit the scope of the claimed subject matter.

Accordingly, in one aspect, there is provided a device for maintaining a plurality of doors in an upright position, the device comprising a body with a plurality of connecting portions extending therefrom, each connecting portion having a connecting surface configured to abut a side of one of the doors.

The body may have a triangular shape, and each connecting portion may be located at a respective vertex of the body. Each connecting portion may be equidistant from the other connecting portions. Each connecting portion may be in the form of a tab and has a score line formed therein adjacent the connecting surface. The score line may have a V-shaped section along its length to provide a line of reduced thickness. Each connecting portion may be configured to be bent along the score line. Each connecting portions may be coplanar along its length with the body. Each connecting portion may be in the form of an angled tab. Each connecting portion may have a bore formed therein for accommodating a fastener. The device may be fabricated of a single piece of material.

In another aspect, there is provided a method of maintaining a plurality of doors in an upright position, the method comprising: connecting a device to each of the doors using a fastener, the device comprising a body with a plurality of connecting portions extending therefrom, each connecting portion having a bore formed therein for accommodating the fastener.

The connecting may comprise connecting the device to a hinge plate recess of each of the doors using the fastener. The fastener may be received in a hinge plate bore of each door. The method may further comprise: prior to said connecting, removing a hinge plate from each of the doors. Each connecting portion of the device may have a connecting surface, wherein said connecting surface may further comprise abutting each connecting surface against a side of each door.

BRIEF DESCRIPTION OF THE DRAWINGS

Embodiments will now be described more fully with reference to the accompanying drawings in which.

DETAILED DESCRIPTION OF THE EMBODIMENTS

Figure 1:
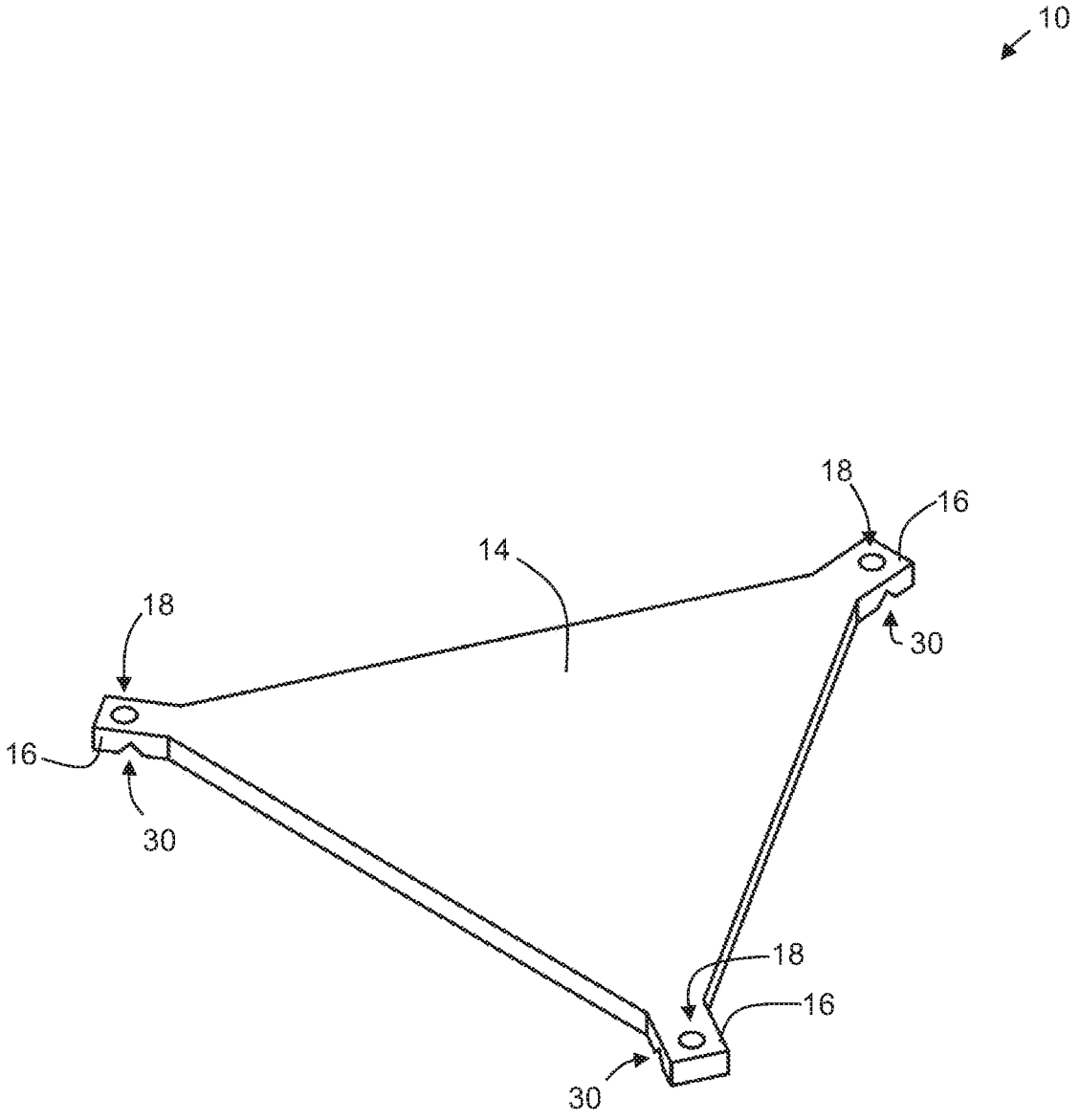
FIG. 1 is a perspective view of a device for maintaining a plurality of doors in an upright position.
Figure 2:
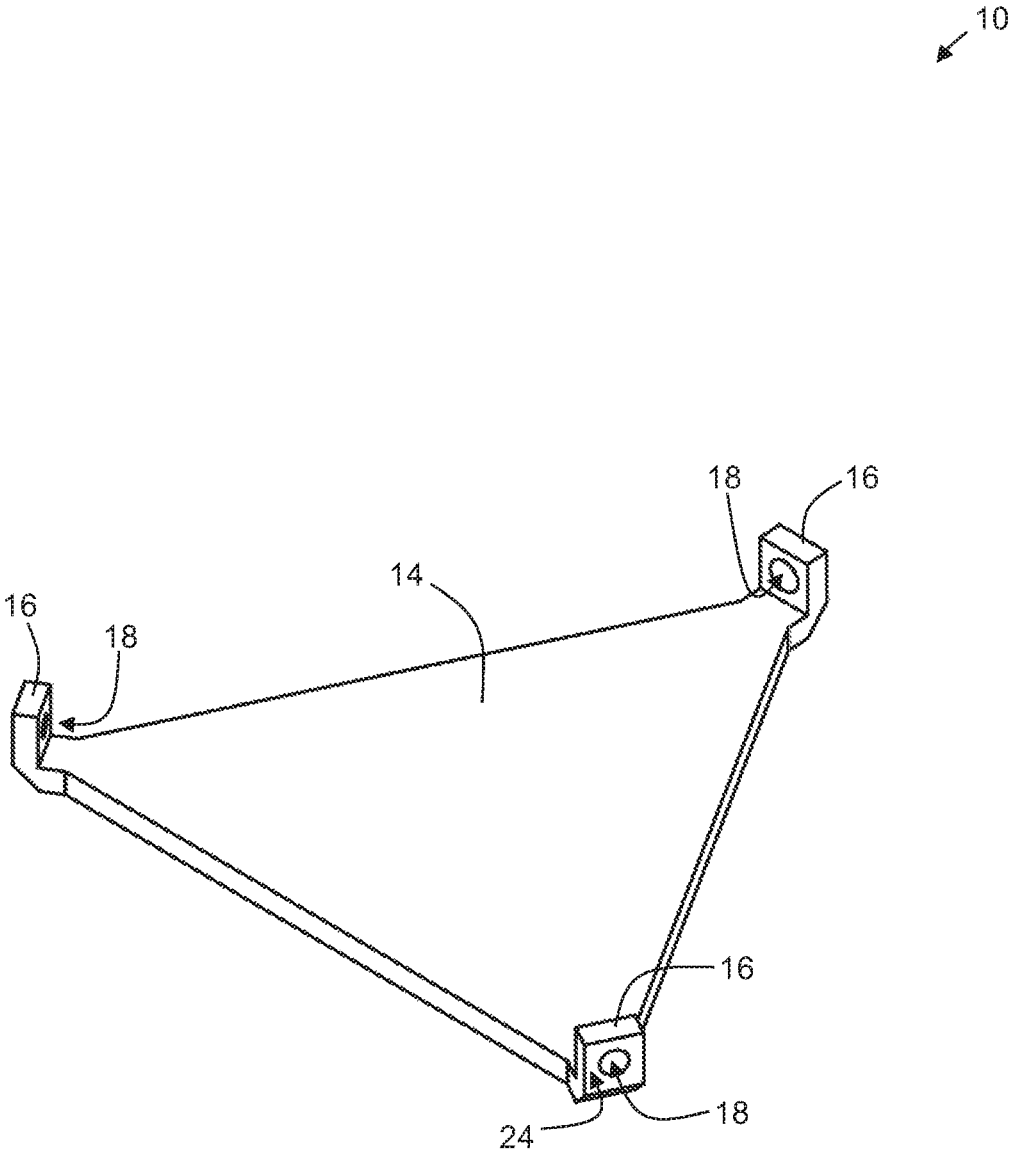
FIG. 2 is a perspective view of the device of FIG. 1, in a use configuration.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Turning now to FIGS. 1 to 5, a device for maintaining a plurality of doors in an upright position is shown, and is generally indicated by reference numeral 10. The device 10 is configured to be connected to three (3) doors 12, for maintaining the doors 12 in an upright and spaced position for treatment, such as the application of paint or finishing materials such as stains, and the like. When the device 10 is connected to the doors 12, the sides of each door are simultaneously accessible for treatment.

The device 10 has a generally planar shape when not in use, and comprises a central, planar body 14 having three (3) connecting portions 16 extending therefrom. In particular, the connecting portions 16 are each coplanar along their length with the body 14 when the device 10 is not in use. The device 10 is fabricated of a single piece of material, and in this embodiment the device 10 is fabricated of high-density polyethylene (HDPE) by injection molding. Each connecting portion 16 is in the form of a tab, and has a bore 18 formed therein for accommodating a fastener 22. Each connecting portion 16 extends radially from the body 14, and in particular each connecting portion 16 is spaced from the other connecting portions 16 such that when the device 10 is maintaining a plurality of doors 12 in the upright position, the sides of each door 12 remain accessible for treatment. In this embodiment, the body 14 has an equilateral triangular shape, and each connecting portion 16 is located at a respective vertex of the body 14 and is equidistant from the other connecting portions 16.

Each connecting portion 16 has a connecting surface 24 that is configured to abut a side of the door 12. Each connecting portion 16 also has a score line 30 formed therein adjacent the connecting surface 24. The score line 30 has a V-shaped section along its length, and provides a line of reduced thickness. As will be understood, each connecting portion 16 is configured to be bent along the score line 30 to allow the connecting surface 24 to be brought into contact with a side of the door 12, during use.

Figure 3:
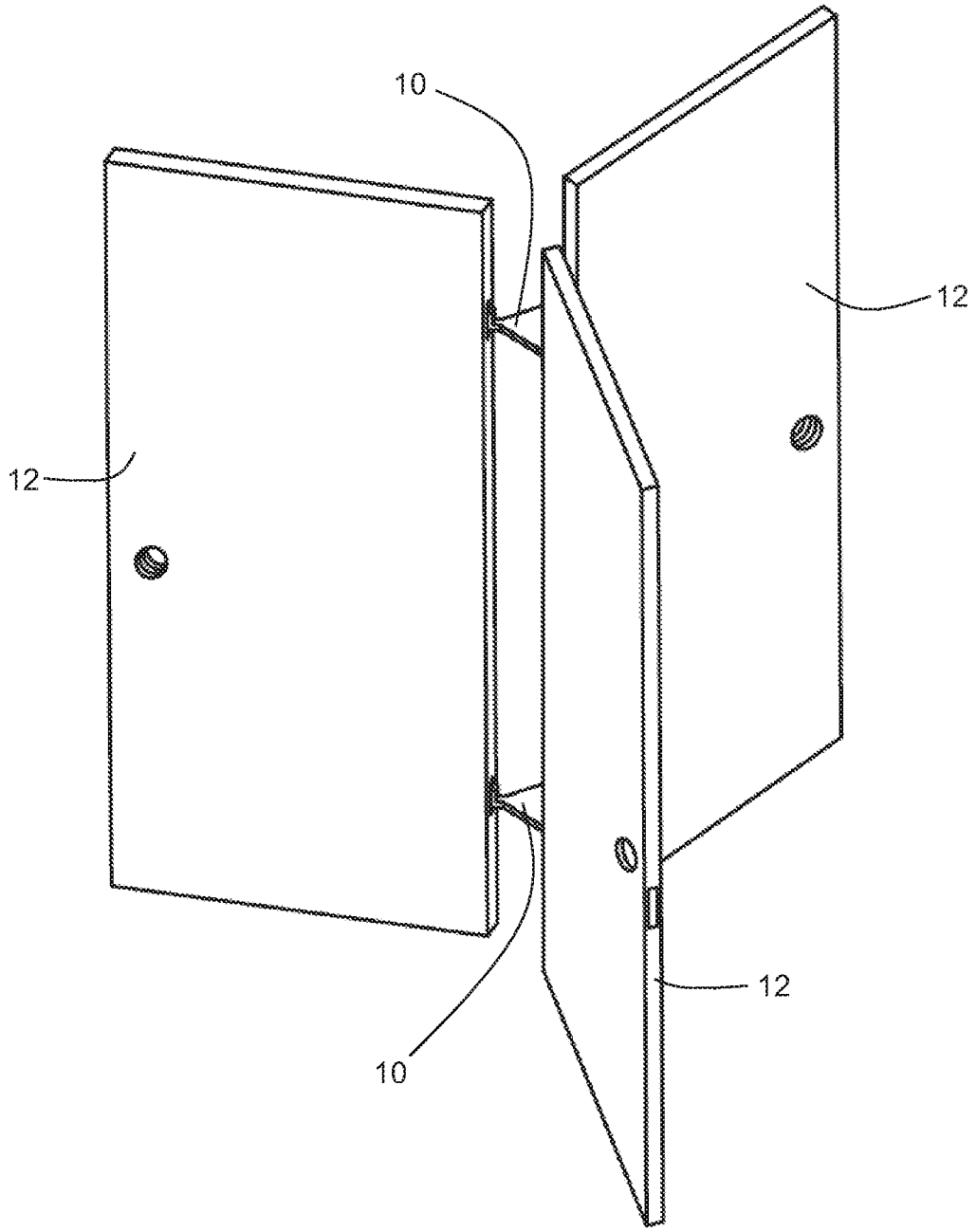
FIG. 3 is a perspective view of a plurality of doors maintained in the upright position using the device of FIG. 1.
Figure 4:
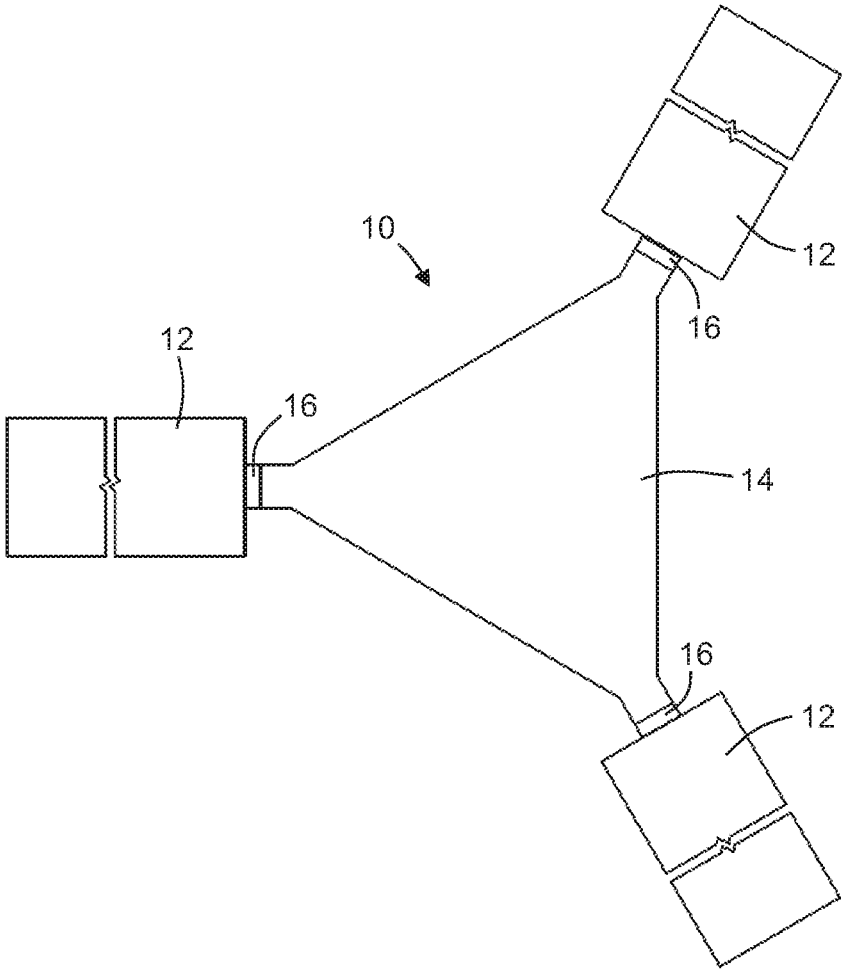
FIG. 4 is a top view of the plurality of doors of FIG. 3 and the device of FIG. 1.
Figure 5:
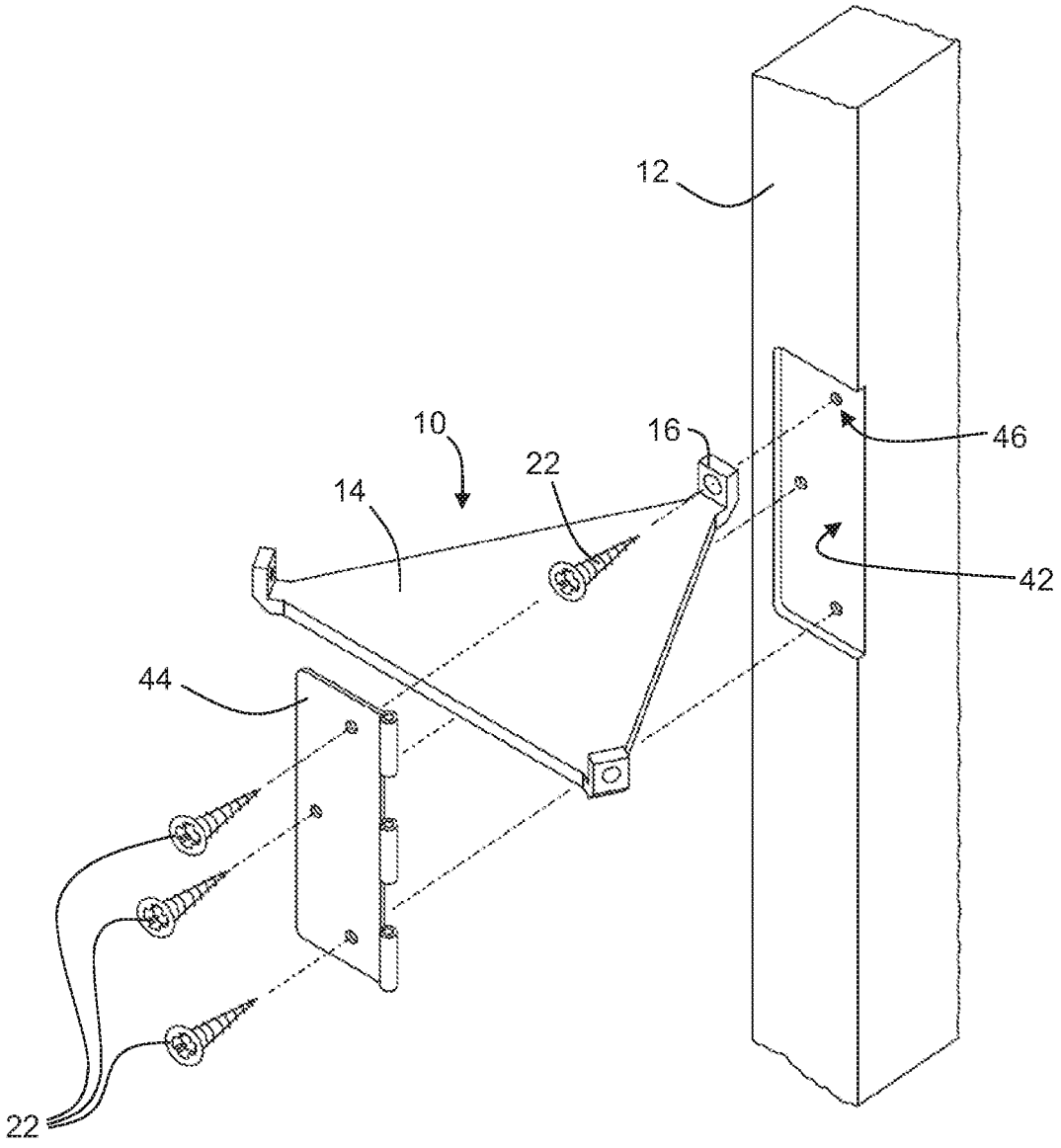
FIG. 5 is a partially exploded view of one of the doors of FIG. 3, showing a hinge plate and the device of FIG. 1.

In the example shown in FIGS. 3 to 5, the connecting surface 24 abuts a hinge plate recess 42 of the door 12, which is configured to accommodate a hinge plate 44 forming part of a door hinge assembly (not shown). When the device 10 is connected to the door 12, the bore 18 of the connecting portion 16 may be aligned with a hinge plate bore 46 formed in the hinge plate recess 42 of the door 12. As will be understood, the hinge plate bores 46 are configured to receive fasteners 22 for fastening each hinge plate 44 to the door 12, and in the example shown the fasteners 22 are hinge screws.

In use, the device 10 is connected to a plurality of doors 12 by first removing hinge plates 44 from the doors 12. With the hinge plates 44 removed, the device 10 is connected directly to each door 12 by abutting the connecting surface 24 of the connecting portion 16 against the hinge plate recess 42 of the door 12, and inserting a fastener 22 through the bore 18 into the hinge plate bore 46 of the door 12. This process is repeated until the three (3) connecting portions 16 are each fastened to a respective door 12. It will be understood that, once the device 10 is connected thereto, the doors 12 cooperate to hold one another in a stable upright position. A second device 10 may be connected to the plurality of doors 12 in the same manner.

As will be understood, if no hinge plate bore 46 exists, or if another already-formed bore (not shown) is desired to be used, the device 10 may alternatively be connected directly to each door 12 by abutting the connecting surface 24 of the connecting portion 16 against a side of the door 12, and either forming a bore in the side of the door 12 by driving the fastener 22 through the bore 18, or inserting a fastener 22 through the bore 18 into the other, already-formed bore.

As will be appreciated, the single piece construction of the device 10 allows the device is simple in nature, and advantageously allows the device 10 to be fabricated at lower cost than conventional devices for maintaining doors in an upright position.

As will be appreciated, the generally planar shape of the device 10 when it is not in use advantageously allows the device 10 to be both shipped and packaged more compactly, and therefore at a lower cost, than conventional devices for maintaining doors in an upright position that do not have a generally planar shape.

Figure 6:
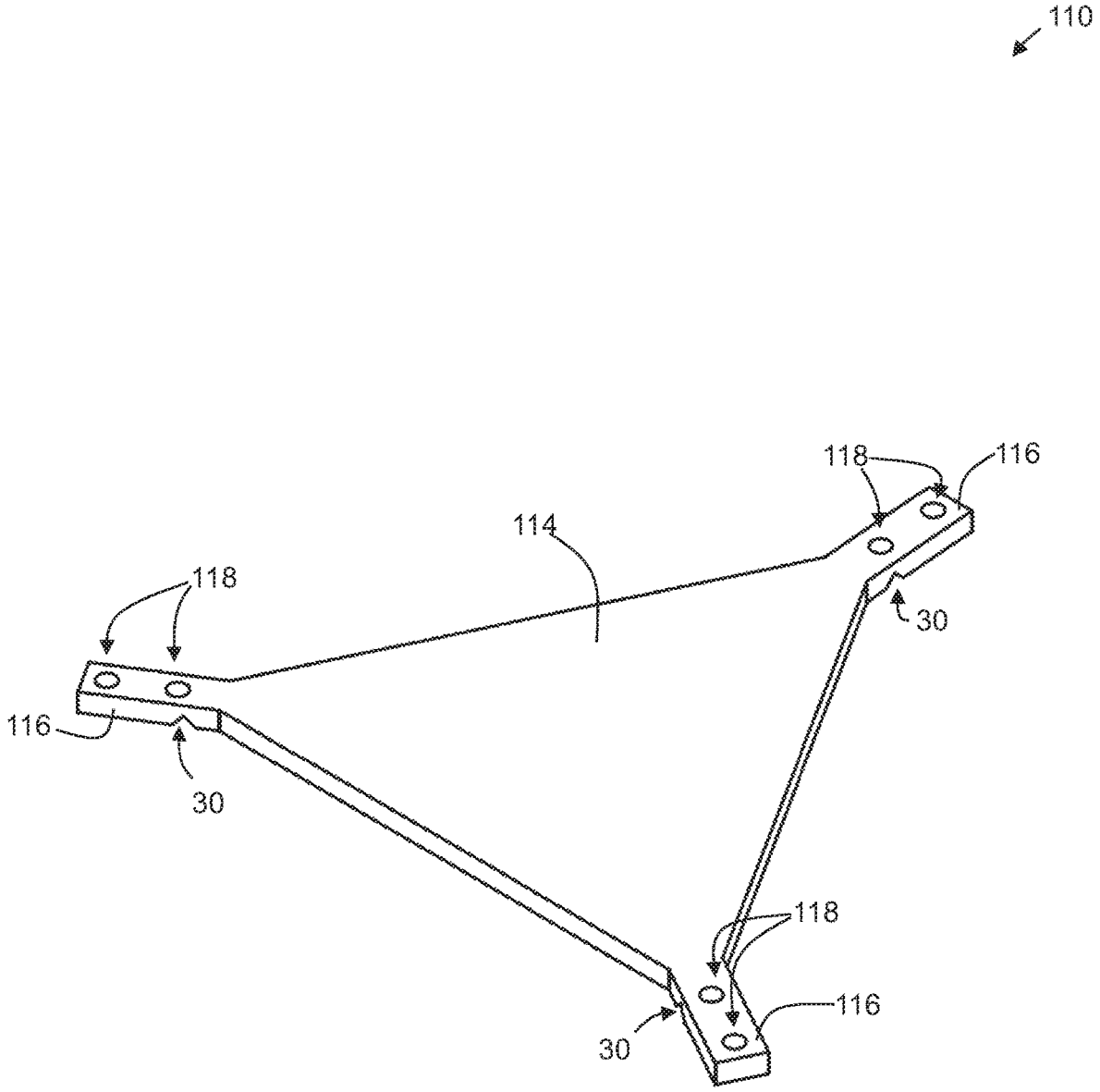
FIG. 6 is a perspective view of another embodiment of a device for maintaining a plurality of doors in an upright position.

In other embodiments, the device may be differently configured. For example, although in the embodiment described above, each connecting portion has a single bore formed therein, in other embodiments, each connecting portion may alternatively have two (2) or more bores formed therein. For example, FIG. 6 shows another embodiment of a device for maintaining a plurality of doors in an upright and spaced position for treatment, generally indicated by reference numeral 110. Device 110 is similar to device 10 described above and with reference to FIGS. 1 to 5, and comprises a central, planar body 114 having three (3) connecting portions 116 extending therefrom. In particular, the connecting portions 116 are each coplanar along their length with the body 114 when the device 110 is not in use. The device 110 is fabricated of a single piece of material, and in this embodiment the device 110 is fabricated of high-density polyethylene (HDPE) by injection molding. Each connecting portion 116 is in the form of a tab, and has two (2) bores 118 formed therein, each bore 118 for accommodating a respective fastener. Each connecting portion 116 extends radially from the body 114, and in particular each connecting portion 116 is spaced from the other connecting portions 116 such that when the device 110 is maintaining a plurality of doors 12 in the upright position, the sides of each door 12 remain accessible for treatment. In this embodiment, the body 114 has an equilateral triangular shape, and each connecting portion 116 is located at a respective vertex of the body 114 and is equidistant from the other connecting portions 116.

Each connecting portion 116 has a connecting surface (not shown) that is configured to abut a side of the door 12. In this embodiment, each connecting portion 116 has the score line 30 formed therein adjacent the connecting surface.

When the device 110 is connected to each door 12, one or both bores 118 of the connecting portion 116 may be aligned with one or two hinge plate bores 46 formed in the hinge plate recess 42 of the door 12. A fastener 22 is then inserted through each of the bores 118 into a respective hinge plate bore 46. If no hinge plate bore 46 exists, or if another bore is desired to be used, the device 110 may alternatively be connected directly to each door 12 by abutting the connecting surface of the connecting portion 116 against a side of the door 12, and either forming a bore in the side of the door 12 by driving the fastener 22 through the bore 118, or inserting a fastener 22 through the bore 118 into the other, already-formed bore.

Figure 7:
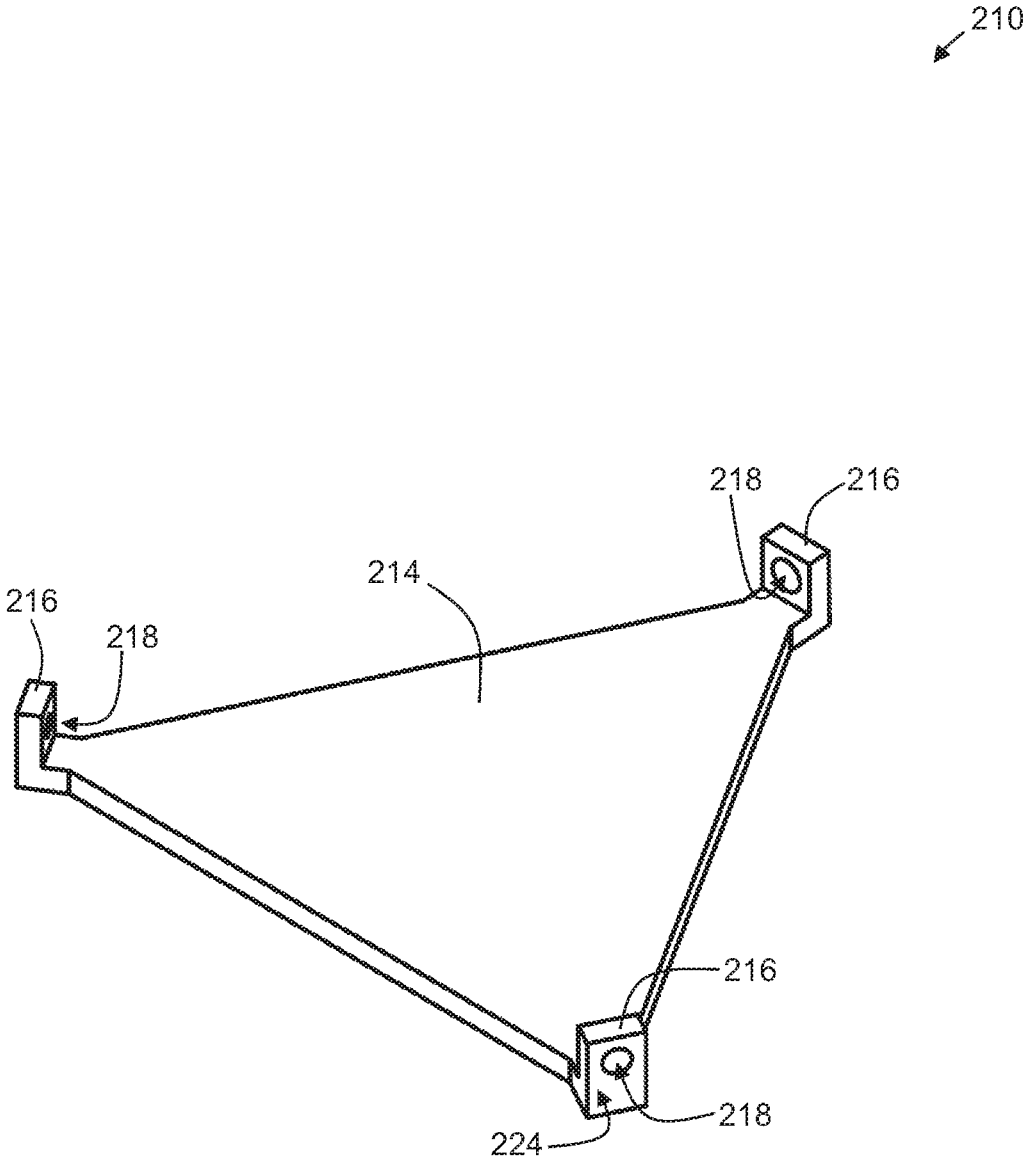
FIG. 7 is a perspective view of still another embodiment of a device for maintaining a plurality of doors in an upright position.

Still other configurations are possible. For example, FIG. 7 shows still another embodiment of a device for maintaining a plurality of doors in an upright and spaced position for treatment, generally indicated by reference numeral 210. Device 210 is generally similar to device 10 described above and with reference to FIGS. 1 to 5, but does not have a generally planar shape when the device is not in use. Rather, the device 210 comprises a central, planar body 214 having three (3) connecting portions 216 extending therefrom. Each connecting portion 216 is in the form of an angled tab, and has a bore 218 formed therein for accommodating a fastener. Each connecting portion 216 extends radially from the body 214, and in particular each connecting portion 216 is spaced from the other connecting portions 216 such that when the device 210 is maintaining a plurality of doors 12 in the upright position, the sides of each door 12 remain accessible for treatment. In this embodiment, the body 214 has an equilateral triangular shape, and each connecting portion 216 is located at a respective vertex of the body 214 and is equidistant from the other connecting portions 216. The device 210 is fabricated of a single piece of material, and in this embodiment the device 210 is fabricated of polyurethane by injection molding.

Each connecting portion 216 has a connecting surface 224 that is configured to abut a side of the door 12. When the device 210 is connected to the door 12, the bore 218 of the connecting portion 216 may be aligned with a hinge plate bore 46 formed in the hinge plate recess 42 of the door 12. A fastener 22 is then inserted through the bores 218 into the hinge plate bore 46. If no hinge plate bore 46 exists, or if another bore is desired to be used, the device 210 may alternatively be connected directly to each door 12 by abutting the connecting surface 224 of the connecting portion 216 against a side of the door 12, and either forming a bore in the side of the door 12 by driving the fastener 22 through the bore 218, or inserting a fastener 22 through the bore 218 into the other, already-formed bore.

Still yet other configurations are possible. For example, although in the embodiments described above, the body of the device has a triangular shape, in other embodiments, the body of the device may alternatively have a different shape, such as for example a generally circular shape. The body may alternatively have still other shapes.

Although in the embodiments described above, the device is fabricated of high-density polyethylene or polyurethane by injection molding, in other embodiments, the device may alternatively be fabricated of another polymer by injection molding. In still other embodiments, the device may alternatively be fabricated of one or more other materials, such as metal sheet, metal plate, wood, and the like.

Although in the embodiments described above, the device is fabricated of a single piece of material, in other embodiments, the device may alternatively be fabricated of multiple pieces of material that are connected to form an effectively unitary device having a body with connecting portions. For example, in one such embodiment, the connecting portions may alternatively be separately fabricated from the body, and joined to the body to provide the device.

Although in the embodiments described above, each connecting portion of the device is equidistant from the other connecting portions, in other embodiments, each connecting portion may alternatively not be equidistant from the other connecting portions, provided that the sides of each door are accessible for treatment when the device is connected to the doors.

Although in the embodiments described above, the device is configured to hold three (3) doors, in other embodiments, the device may alternatively be configured to hold fewer than or more than three (3) doors, provided the doors are spaced sufficiently to allow the sides of each door to be accessible for treatment when the device is connected to the doors. For example, in other embodiments, the device may alternatively be configured to hold more than three (3) doors. If the device is used to hold up only one (1) door for finishing, it may be helpful to couple at least one other unused connecting portion to a door frame or to another supporting structure, so as to stabilize the device and the door.

Although in the embodiments described above, the connecting portion of the device defines a bore in the body of device, in other embodiments, one of the connecting portions may alternatively comprise a threaded protruding member (not shown). The threaded protruding member could be substantially elongate with a diameter and outer threading commensurate with those of a hinge screw configured to engage the hinge plate bore of the door frame. With the device fastened to the door frame in this manner, one or more doors could then be connected to the device in the manner described above.

Although embodiments have been described above with reference to the accompanying drawings, those of skill in the art will appreciate that variations and modifications may be made without departing from the scope thereof as defined by the appended claims.

What is claimed is:

1. A device for maintaining a plurality of doors in an upright position, the device comprising a body with at least three connecting portions each extending from the body along a radial direction passing through the center of the body, each said connecting portion having a connecting surface configured to abut a side of one of the doors, each said connecting portion configured to bend to provide the connecting surface perpendicular to the radial direction, wherein each said connecting portion is in the form of a tab, and wherein the device is fabricated of a single piece of material.

2. The device of claim 1, wherein the body has a triangular shape, and each said connecting portion is located at a respective vertex of the body.

3. The device of claim 1, wherein each said connecting portion is equidistant from the other said connecting portions.

4. The device of claim 1, wherein each said connecting portion is coplanar along its length with the body.

5. The device of claim 1, wherein each said connection portion has at least one bore formed therein for accommodating a fastner.

6. The device of claim 1, wherein the body has a triangular shape, and each said connecting portion is located at a respective vertex of the body.

7. The device of claim 1, wherein each said connecting portion is equidistant from the other connecting portions.

8. The device of claim 1, wherein each said connecting portion has a score line formed therein adjacent the connecting surface.

9. The device of claim 8, wherein the score line has a V-shaped section along its length to provide a line of reduced thickness.

10. The device of claim 8, wherein each said connecting portion is configured to be bent along the score line.

11. The device of claim 1, wherein the at least three connecting portions consists of three connecting portions.

* * * * *